US011629550B2

(12) United States Patent
Przydzial

(10) Patent No.: US 11,629,550 B2
(45) **Date of Patent: *Apr. 18, 2023**

(54) BOTTOM ASSEMBLY FOR A BREAKAWAY DOOR

(71) Applicant: Performax Global, Aston, PA (US)

(72) Inventor: Grzegorz Przydzial, Sedziszow Mlp. (PL)

( * ) Notice: Subject to any disclaimer, the term of this patent is extended or adjusted under 35 U.S.C. 154(b) by 0 days.

This patent is subject to a terminal disclaimer.

(21) Appl. No.: 17/221,594

(22) Filed: Apr. 2, 2021

(65) Prior Publication Data

US 2021/0222485 A1 Jul. 22, 2021

Related U.S. Application Data

(63) Continuation of application No. 15/996,315, filed on Jun. 1, 2018, now Pat. No. 10,968,691.

(60) Provisional application No. 62/514,648, filed on Jun. 2, 2017.

(51) Int. Cl.

| | |
|---|---|
| ***E06B 9/17*** | (2006.01) |
| ***E06B 9/06*** | (2006.01) |
| ***E06B 9/58*** | (2006.01) |

(52) U.S. Cl.

CPC ..... *E06B 9/17046* (2013.01); *E06B 9/0692* (2013.01); *E06B 9/17076* (2013.01); *E06B 9/581* (2013.01)

(58) Field of Classification Search

CPC ..... E06B 9/17046; E06B 9/0692; E06B 9/17076; E06B 9/581

USPC ..... 52/173.2

See application file for complete search history.

(56) References Cited

U.S. PATENT DOCUMENTS

| | | | | |
|---|---|---|---|---|
| 3,665,997 | A ‡ | 5/1972 | Smith | B65G 69/008 52/173.2 |
| 5,758,705 | A ‡ | 6/1998 | Wagner | E06B 9/13 160/265 |
| 5,765,622 | A ‡ | 6/1998 | Lichy | E06B 9/13 160/201 |
| 6,722,416 | B2 * | 4/2004 | Varley | E06B 9/70 160/264 |
| 2005/0205218 | A1 * | 9/2005 | Snyder | E06B 9/17046 160/133 |
| 2007/0169896 | A1 ‡ | 7/2007 | Snyder | E06B 9/17046 160/133 |
| 2008/0104902 | A1 ‡ | 5/2008 | Ashelin | B65G 69/008 52/173.2 |

(Continued)

*Primary Examiner* — Patrick J Maestri

(74) *Attorney, Agent, or Firm* — Faegre Drinker Biddle & Reath; Victor Jonas; Johnathon Webb

(57) ABSTRACT

The present invention is a bottom assembly for a breakaway door. The bottom assembly comprises a first mounting plate fixed on one of the faces of the breakaway door proximate to its bottom and a security edge formed of a loop of flexible material suspended from the bottom of the breakaway door. The security edge has a second tab sandwiched between the first mounting plate and the breakaway door to mount the security edge to the breakaway door. The loop of flexible material has an interior void at least partially filled with an internal cushion. The bottom assembly further includes a first padded bar including a bumper and a first tab extending from the bumper wherein the first tab is sandwiched between the first mounting plate and the breakaway door to mount the first padded bar to said breakaway door.

18 Claims, 6 Drawing Sheets

(56) References Cited

U.S. PATENT DOCUMENTS

| | | | | |
|---|---|---|---|---|
| 2011/0083815 | A1‡ | 4/2011 | Kriner | E06B 3/80 160/127 |
| 2013/0068400 | A1‡ | 3/2013 | Dwarka | E06B 9/58 160/120 |
| 2016/0376841 | A1‡ | 12/2016 | Hentschel | E06B 9/581 160/270 |

* cited by examiner
‡ imported from a related application

FIG. 2A
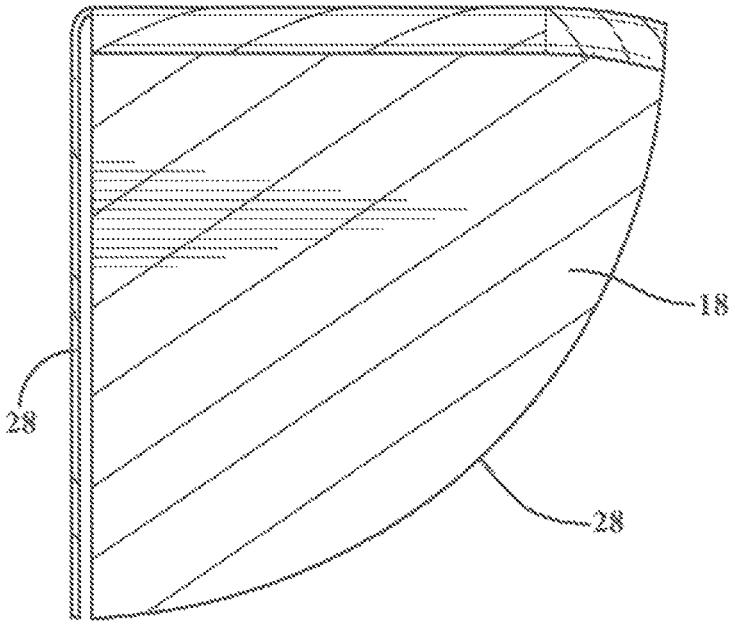
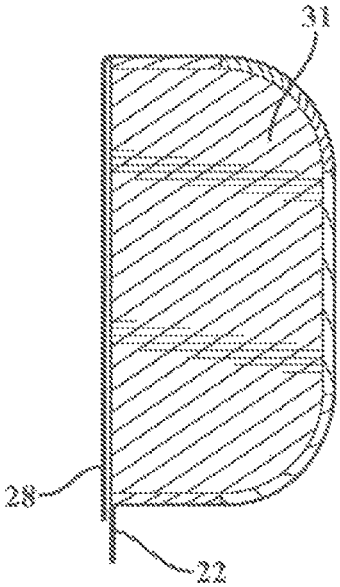
FIG. 2B
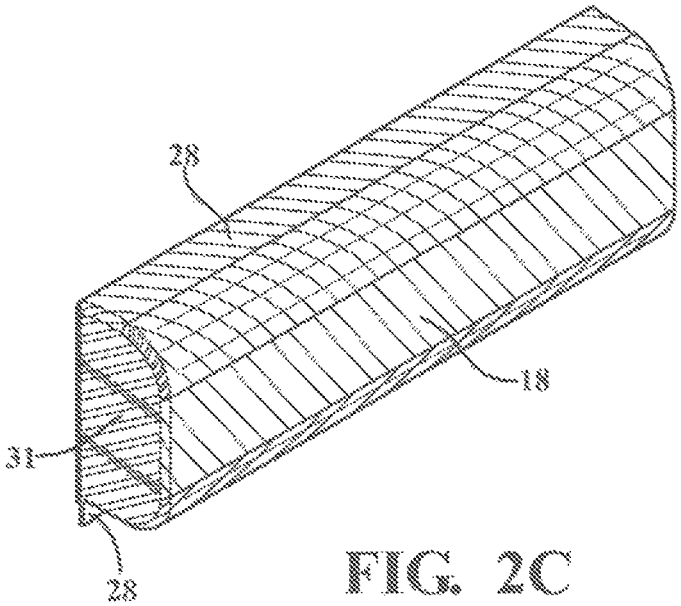
FIG. 2C

FIG. 3A
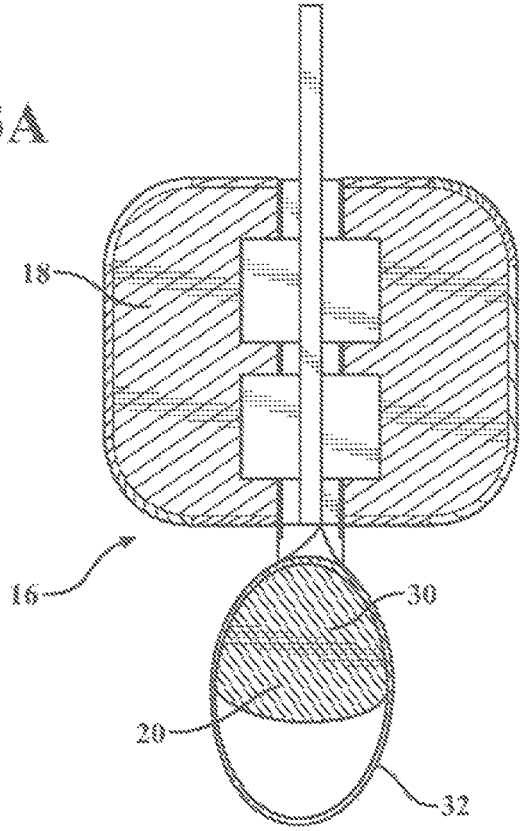
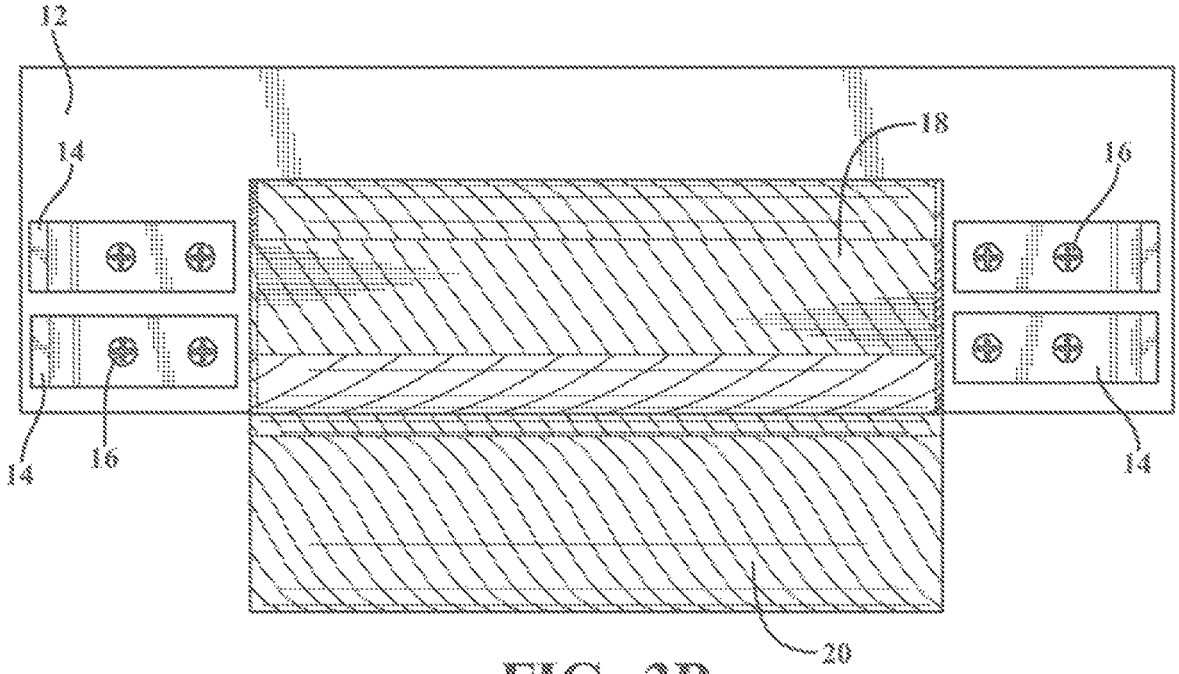
FIG. 3B

BOTTOM ASSEMBLY FOR A BREAKAWAY DOOR

RELATED APPLICATIONS

This application is a continuation of U.S. application Ser. No. 15/996,315 entitled "PADDED BOTTOM AND SECURITY EDGE FOR BREAKAWAY DOOR," filed Jun. 1, 2018, which claims the benefit of U.S. Provisional Application No. 62/514,648, filed on Jun. 2, 2017, which is incorporated herein by reference.

STATEMENT REGARDING FEDERALLY SPONSORED RESEARCH

NONE.

TECHNICAL FIELD

This invention relates generally to breakaway doors.

BACKGROUND OF THE INVENTION

Commercial buildings commonly use roll up doors to open and close large entryways, such as loading bays. Roll up doors can be made of various materials, aluminum, steel, vinyl and rubber are common materials. Roll up flexible doors are typically made of vinyl or rubber. A rotating shaft allows the material to be rolled onto and unrolled from the shaft. Some of these doors include tracks mounted on the sides of the opening to guide and hold the flexible material in place.

Some flexible doors are breakaway doors. Breakaway doors release from the guide tracks when impacted by for example a vehicle. This reduces or eliminates damage to the door and the building. These doors can be quickly reset with a minimum of effort.

The problem with breakaway doors is that they have a metal plate at the bottom to weigh down the door and assist in closing. This metal plate flies into the air when the door is impacted and crashes into the vehicle. This can cause damage to the vehicle. A breakaway door is needed that will not damage a vehicle in the event of impact with the door.

SUMMARY OF THE INVENTION

The present invention comprises a bottom assembly for a breakaway door. The bottom assembly comprises a first mounting plate fixed on one of the faces of the breakaway door proximate to its bottom and a security edge formed of a loop of flexible material suspended from the bottom of the breakaway door. The security edge has a second tab sandwiched between the first mounting plate and the breakaway door to mount the security edge to the breakaway door. The loop of flexible material has an interior void at least partially filled with an internal cushion. The bottom assembly further includes a first padded bar including a bumper and a first tab extending from the bumper wherein the first tab is sandwiched between the first mounting plate and the breakaway door to mount the first padded bar to said breakaway door.

The internal cushion may be attached to the loop of flexible within the interior void adjacent to an upper portion of said loop. Furthermore, the internal cushion may not fill the interior void adjacent to a bottom portion of the loop thus allowing the bottom portion of the loop to deform upon contact with flooring underneath the breakaway door.

The internal cushion may be formed of an elastomeric material, which may be rubber. The loop of flexible material may be formed of vinyl.

The bottom assembly may further include a second mounting plate fixed on the opposed sides of the breakaway door substantially opposite to the first mounting plate proximate to the bottom of the door as well as a second padded bar that has a second bumper and a third tab extending from the second bumper, such that the third tab may be sandwiched between the second mounting plate and the breakaway door to mount the second padded bar to the door.

The present invention may also be thought to comprise a security edge for a breakaway door wherein the security edge comprises a mounting plate fixed proximate to the bottom of the breakaway door and a bottom loop formed of a flexible material suspended from the bottom of the breakaway door. The bottom loop has a second tab sandwiched between the plate and the breakaway door to mount the bottom loop to the breakaway door. The bottom loop further has an interior void, which is at least partially filled with an internal cushion. The internal cushion may be attached to the bottom loop within the interior void adjacent to an upper portion of the bottom loop. The internal cushion may not fill the interior void adjacent to a bottom portion of the bottom loop thus allowing the bottom portion of the bottom loop to deform upon contact with flooring underneath the breakaway door. The internal cushion may be formed of an elastomeric material, which may be rubber. The flexible material may be vinyl.

The security edge may further include a padded bar including a bumper and a first tab extending from the bumper, wherein the first tab is sandwiched between the mounting plate and the breakaway door to mount the padded bar to the breakaway door over the mounting plate. The security edge may further comprise a fastener affixing the mounting plate to the breakaway door proximate to said bottom.

These and other features and advantages of this invention will become more apparent to those skilled in the art from the detailed description of a preferred embodiment. Described below are the drawings that accompany the detailed description.

BRIEF DESCRIPTION OF THE DRAWINGS

FIG. 2A is a detailed view of the padded cushion for breakaway doors of the present invention taken from FIG. 1.

FIG. 2B is an end view of the padded cushion of FIG. 2A illustrating the interrelationship of the padded cushion, first tab, and plate.

FIG. 2C is a perspective view of FIG. 2B.

FIG. 3A is an end view of the padded bottom and security edge for breakaway doors of the present invention.

FIG. 3B is a side view of the padded bottom and security edge for breakaway doors of the present invention.

DETAILED DESCRIPTION OF A PREFERRED EMBODIMENT

Figure 1:
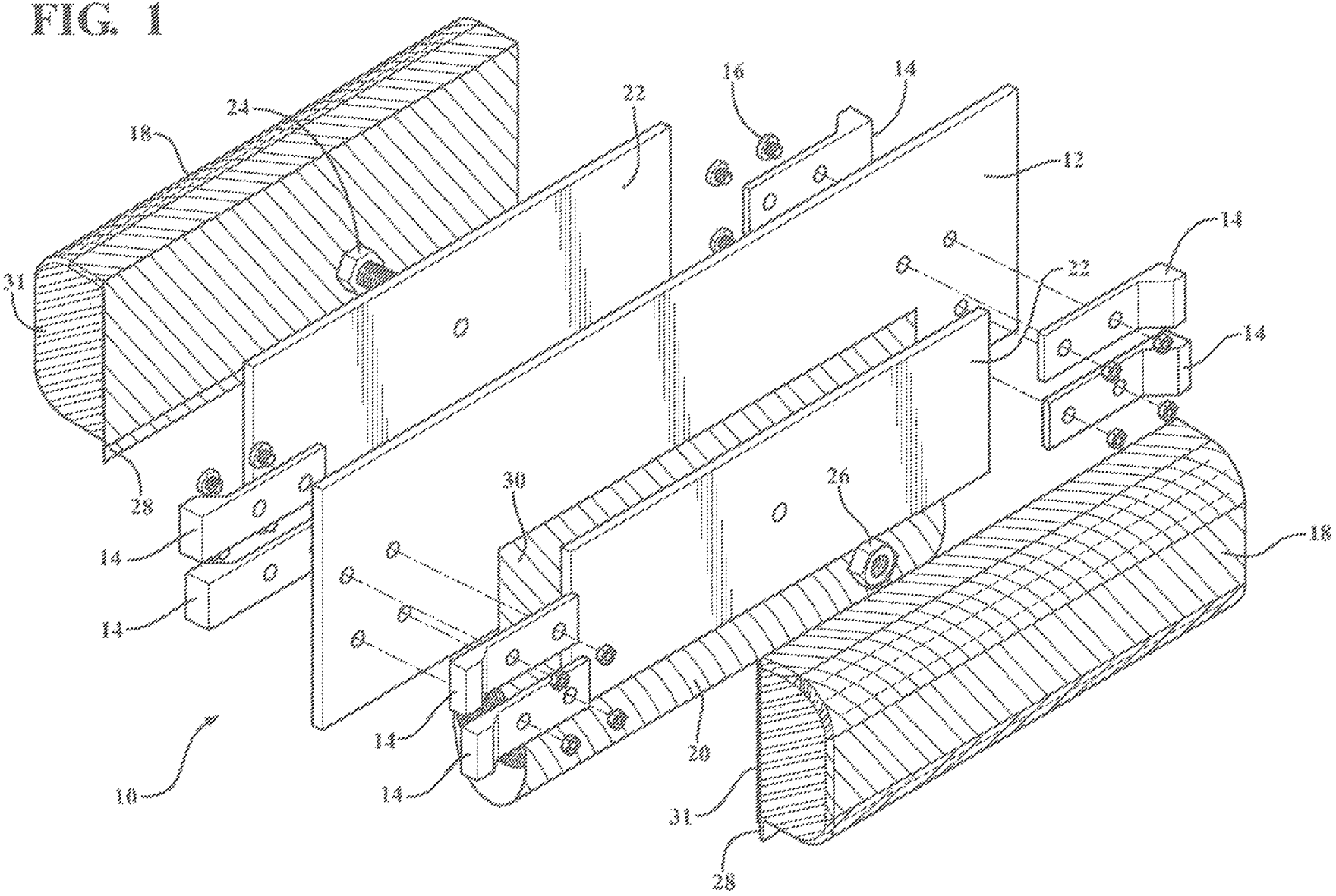
FIG. 1 is an exploded view of the padded bottom and security edge for breakaway doors of the present invention.
Figure 3C:
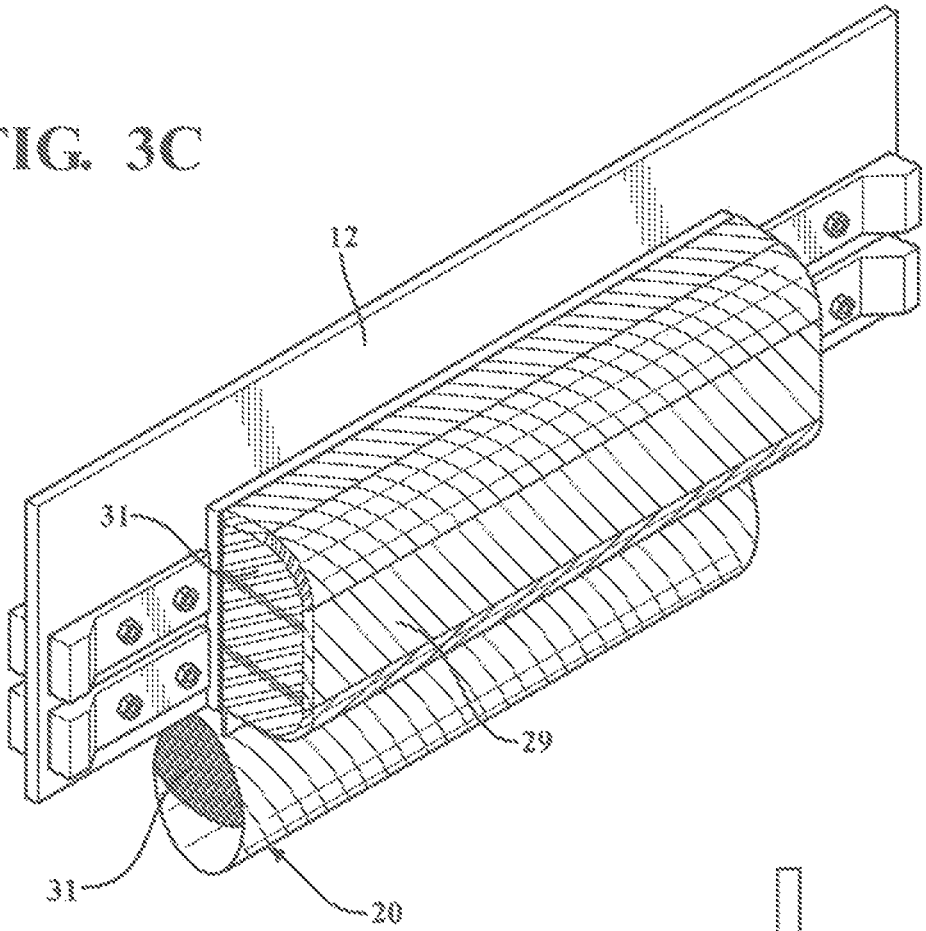
FIG. 3C is a perspective view of the padded bottom and security edge for breakaway doors of the present invention.
Figure 4A:
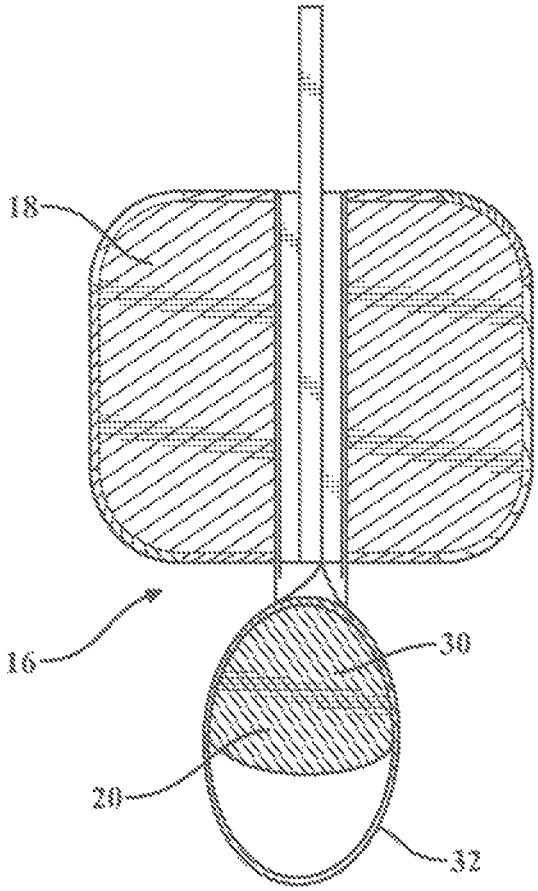
FIG. 4A is a cross sectional view taken along line A-A of FIG. 3C.
Figure 4B:
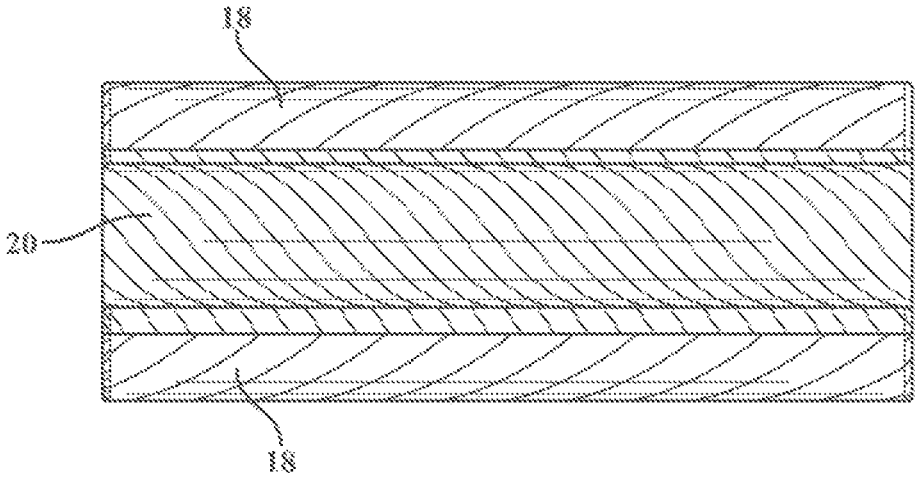
FIG. 4B is a bottom view of the padded bottom and security edge for breakaway doors of the present invention.
Figure 4C:
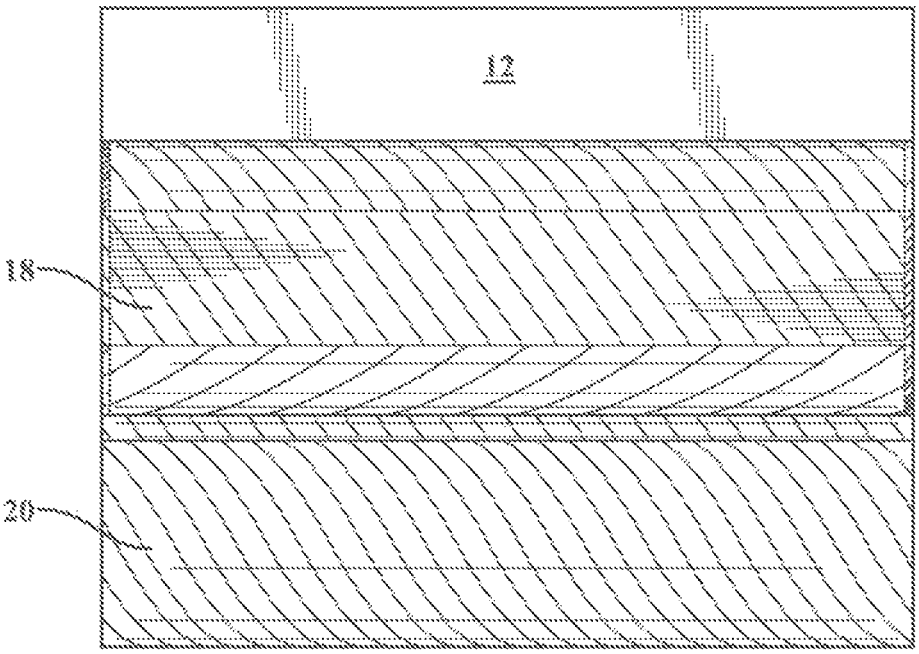
FIG. 4C is a side view of the padded bottom and security edge for breakaway doors of the present invention.
Figure 4D:
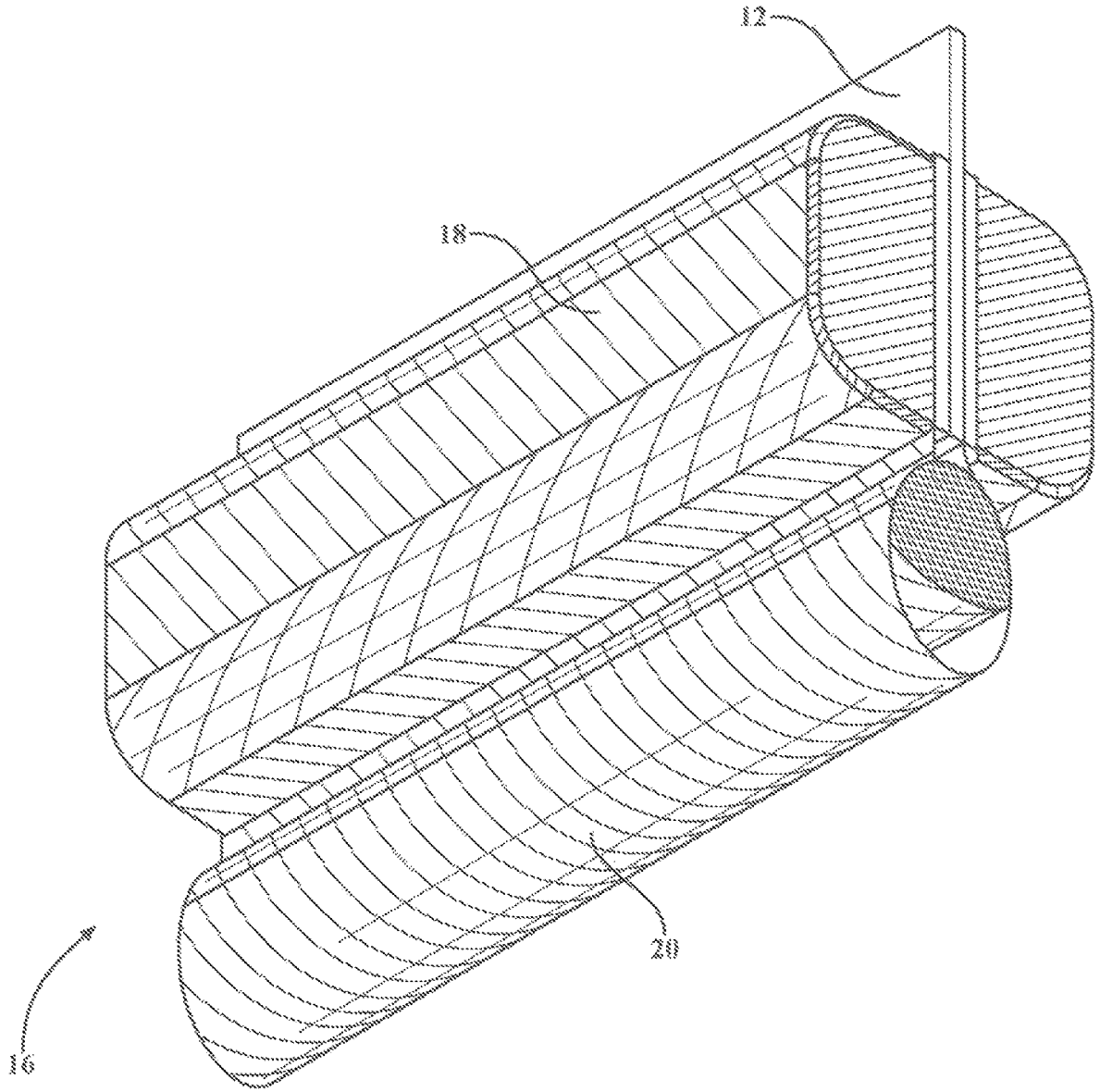
FIG. 4D is a bottom perspective view of the padded bottom and security edge for breakaway doors of the present invention.

With reference to the various FIGS. 1 thru 4, the padded bottom bar and security edge of the present invention is illustrated generally at 10. Those of ordinary skill in the art will appreciate that this is a partial representation of the door 12. The door 12 would be taller and wider to span the opening of a building. The padded bottom and security edge 10 of the present invention would typically extend along the entire bottom edge of the breakaway door 12. In the alternative, the padded bottom and security edge 10 of the present invention could be several sections spaced along the width of the door 12.

Typically, industrial facilities use breakaway doors 12 to close the door opening to a loading dock etc. The doors 12 are typically roll up rubber doors. The rubber doors are resistant to improper entry due to their size and the thickness of the rubber used to make the rubber door. The padded bottom bar and security edge 10 is typically used on breakaway rubber doors. Breakaway doors have side locks that are received in tracks and allow the door to be released from the tracks upon inadvertent impact. In this way, damage to the door, tracks and building are reduced or even eliminated. In most situations, the locks can be reinserted into the tracks after impact so that the door can continue to be used after.

In the disclosed embodiment, the breakaway rubber door 12 includes locks 14. Bolts and nuts 16 fasten the locks 14 to the edges of the rubber door 12. Other attachment methods could be used, such as screws, rivets, adhesives, etc. Tracks mounted on the sides of the door opening receive the locks 14 to release the door from the tracks upon inadvertent impact. The padded bottom and security edge 10 reduces or prevents damage to vehicles that may inadvertently collide with the rubber door 12. The padded bottom and security edge 10 is made of relatively soft material and will reduce or eliminate damage to a vehicle upon impact.

Typically, a metal bar is provided along the bottom of the rubber door 12 and upon inadvertent collision, the vehicle can be damaged because of impact with the metal bottom bar. The present padded bottom bar and security edge 10 of the present invention provides a bottom bar that reduces or eliminates damage to a vehicle.

The padded bottom bar and security edge 10 of the present invention includes front and back padded cushions 18 which are mounted through a plate 22 to the bottom edge of the rubber door 12. The security edge 20 is mounted to the bottom edge of the rubber door 12. In the disclosed embodiment, a plate 22 is mounted through bolts 24 and 26 to the bottom of the rubber door 12. As will be appreciated, there are a number of bolts 24 and 26 located along the elongated plate 22, which extends across the bottom of the rubber door 12. In the alternative, the padded bottom bar and security edge 10 could be made in smaller sections and mounted along the bottom of the rubber door 12.

In the disclosed embodiment, the cushions 18 have an exterior covering 29 with a first tab or flap 28. The tab or flap 28 in the disclosed embodiment is an extension of the exterior covering 29. The tab or flap 28 is received behind plates 22 to secure the pad 18 to the bottom edge of the rubber door 12. The security edge 20 includes a second tab 30 or flap that is also mounted between the plates 22 to secure the security edge 20 to the bottom edge of the door 12.

The security edge includes an internal cushion or pad, such as rubber 31 and an external material 32. The padded bottom bars 18 also include an external material 29 and a rubber internal material 31. In the disclosed embodiment, the exterior material 29 and 32 is vinyl.

In the disclosed embodiment, the door 12 has padded bottom bars 18 on the front and back of the door. It should be appreciated by those of ordinary skill in the art that door 12 could have a single pad 18 on one side of the door 12 if desired.

As will be appreciated by those of ordinary skill in the art the present invention is a simple, inexpensive and easy to install padded bottom bar and security edge 10 to reduce and even prevent damage to vehicles upon impact of the rubber door 12 by for example a vehicle. Additionally, the security edge 20 provides a seal for the door to prevent the ingress of air underneath the door and securely closes the bottom of the door.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A bottom assembly for a breakaway door having a top, opposed sides and a bottom, said bottom assembly comprising:

a first mounting plate fixed on one of said opposed sides of said breakaway door proximate to said bottom of said breakaway door;

a security edge formed of a loop of flexible material suspended from said bottom of said breakaway door, said security edge having a second tab sandwiched between said first mounting plate and said breakaway door to mount said security edge to said breakaway door, said loop of flexible material having an interior void, said interior void being at least partially filled with an internal cushion; and a first padded bar including a bumper and a first tab extending from said bumper, said first tab being sandwiched between said first mounting plate and said breakaway door to mount said first padded bar to said breakaway door, wherein the internal cushion is attached to said loop of flexible material within said interior void adjacent to an upper portion of said loop of flexible material.

2. The bottom assembly of claim 1, wherein the internal cushion does not fill said interior void adjacent to a bottom portion of said loop thus allowing said bottom portion of said loop to deform upon contact with flooring underneath the breakaway door.

3. The bottom assembly of claim 2, wherein said internal cushion is formed of an elastomeric material.

4. The bottom assembly of claim 3, wherein said elastomeric material is rubber.

5. The bottom assembly of claim 4, wherein said loop of flexible material is vinyl.

6. The bottom assembly of claim 5, further comprising:

a second mounting plate fixed on one of said opposed sides of said breakaway door substantially opposite to said first mounting plate proximate to said bottom of said breakaway door;

a second padded bar including a second bumper and a third tab extending from said second bumper, said third tab being sandwiched between said second mounting plate and said breakaway door to mount said second padded bar to said breakaway door.

7. The bottom assembly of claim 1, wherein said loop of flexible material is vinyl.

8. A security edge for a breakaway door having a top, opposed sides and a bottom, said security edge comprising:

a mounting plate fixed proximate to said bottom of said breakaway door; and a bottom loop formed of a flexible material suspended from said bottom of said breakaway door, said bottom loop having a tab sandwiched between said plate and said breakaway door to mount said bottom loop to said breakaway door, said bottom loop containing an interior void, said interior void being at least partially filled with an internal cushion, wherein the internal cushion is attached to said bottom loop within said interior void adjacent to an upper portion of said bottom loop.

9. The security edge of claim 8, wherein the internal cushion does not fill said interior void adjacent to a bottom portion of said bottom loop thus allowing said bottom portion of said bottom loop to deform upon contact with flooring underneath the breakaway door.

10. The security edge of claim 9, wherein said internal cushion is formed of an elastomeric material.

11. The security edge of claim 10, wherein said elastomeric material is rubber.

12. The security edge of claim 11, wherein said flexible material is vinyl.

13. The security edge of claim 8, wherein said flexible material is vinyl.

14. The security edge of claim 8, wherein the tab of said bottom loop is a second tab, and wherein the security edge further comprises a first padded bar including a bumper and a first tab extending from said bumper, said first tab being sandwiched between said first mounting plate and said breakaway door to mount said first padded bar to said breakaway door over said mounting plate.

15. The security edge of claim 8 further comprising a fastener affixing said mounting plate to said breakaway door proximate to said bottom.

16. A bottom assembly for a breakaway door having a top, opposed sides and a bottom, said bottom assembly comprising:

a first mounting plate fixed on one of said opposed sides of said breakaway door proximate to said bottom of said breakaway door;

a security edge formed of a loop of flexible material suspended from said bottom of said breakaway door, said security edge having a second tab sandwiched between said first mounting plate and said breakaway door to mount said security edge to said breakaway door, said loop of flexible material having an interior void, said interior void being at least partially filled with an internal cushion; and a first padded bar including a bumper and a first tab extending from said bumper, said first tab being sandwiched between said first mounting plate and said breakaway door to mount said first padded bar to said breakaway door, wherein said internal cushion is formed of an elastomeric material.

17. A bottom assembly for a breakaway door having a top, opposed sides and a bottom, said bottom assembly comprising:

a first mounting plate fixed on one of said opposed sides of said breakaway door proximate to said bottom of said breakaway door;

a security edge formed of a loop of flexible material suspended from said bottom of said breakaway door, said security edge having a second tab sandwiched between said first mounting plate and said breakaway door to mount said security edge to said breakaway door, said loop of flexible material having an interior void, said interior void being at least partially filled with an internal cushion;

a first padded bar including a bumper and a first tab extending from said bumper, said first tab being sandwiched between said first mounting plate and said breakaway door to mount said first padded bar to said breakaway door;

a second mounting plate fixed on one of said opposed sides of said breakaway door substantially opposite to said first mounting plate proximate to said bottom of said breakaway door; and a second padded bar including a second bumper and a third tab extending from said second bumper, said third tab being sandwiched between said second mounting plate and said breakaway door to mount said second padded bar to said breakaway door.

18. A security edge for a breakaway door having a top, opposed sides and a bottom, said security edge comprising:

a mounting plate fixed proximate to said bottom of said breakaway door; and a bottom loop formed of a flexible material suspended from said bottom of said breakaway door, said bottom loop having a tab sandwiched between said plate and said breakaway door to mount said bottom loop to said breakaway door, said bottom loop containing an interior void, said interior void being at least partially filled with an internal cushion, wherein said internal cushion is formed of an elastomeric material.

* * * * *